US008808149B2

(12) United States Patent
Huang

(10) Patent No.: US 8,808,149 B2
(45) Date of Patent: Aug. 19, 2014

(54) PEDAL CORRECTION MECHANISM FOR ELLIPTICAL TRAINER

(75) Inventor: Hsuan-Fu Huang, ChangHua County (TW)

(73) Assignee: Dyaco International Inc., Taipei (TW)

( * ) Notice: Subject to any disclaimer, the term of this patent is extended or adjusted under 35 U.S.C. 154(b) by 373 days.

(21) Appl. No.: 13/344,923

(22) Filed: Jan. 6, 2012

(65) Prior Publication Data

US 2013/0085042 A1 Apr. 4, 2013

(30) Foreign Application Priority Data

Sep. 30, 2011 (TW) ..... 100218442 U

(51) Int. Cl.

| | |
|---|---|
| ***A63B 22/04*** | (2006.01) |
| ***A63B 22/12*** | (2006.01) |
| ***A63B 21/22*** | (2006.01) |
| ***A63B 22/00*** | (2006.01) |
| ***A63B 22/20*** | (2006.01) |
| ***A63B 22/06*** | (2006.01) |

(52) U.S. Cl.

CPC ..... *A63B 22/04* (2013.01); *A63B 21/225* (2013.01); *A63B 22/001* (2013.01); *A63B 22/203* (2013.01); *A63B 22/0664* (2013.01)

USPC ..... 482/52; 482/62

(58) Field of Classification Search

USPC ..... 482/52, 57–65, 79–80

See application file for complete search history.

(56) References Cited

U.S. PATENT DOCUMENTS

| | | | | |
|---|---|---|---|---|
| 5,690,589 | A * | 11/1997 | Rodgers, Jr. | 482/57 |
| 7,037,242 | B2 * | 5/2006 | Lo et al. | 482/52 |
| 7,276,017 | B2 * | 10/2007 | Chen | 482/52 |
| 7,727,120 | B2 * | 6/2010 | Smith | 482/52 |
| 7,871,356 | B2 * | 1/2011 | Smith | 482/52 |
| 8,376,913 | B2 * | 2/2013 | Lee et al. | 482/52 |
| 2007/0161464 | A1 * | 7/2007 | Chiles et al. | 482/52 |
| 2008/0280733 | A1 * | 11/2008 | Dickie et al. | 482/52 |

* cited by examiner

*Primary Examiner* — Stephen Crow

(74) *Attorney, Agent, or Firm* — Huffman Law Group, PC

(57) ABSTRACT

A pedal correction mechanism used in an elliptical trainer is disclosed to include a pedal link having a coupling portion at the inner side thereof, and a pedal bracket carrying a pedal and having a shaft pivotally inserted into the coupling portion of the pedal link for allowing the pedal bracket to be biased leftwards and rightwards on the axis of the shaft relative to the pedal link to eliminate cumulative tolerances among component parts, preventing derailment and reducing noises.

4 Claims, 4 Drawing Sheets

PEDAL CORRECTION MECHANISM FOR ELLIPTICAL TRAINER

BACKGROUND OF THE INVENTION

1. Field of the Invention

The present invention relates to elliptical trainers and more particularly, to a pedal correction mechanism for elliptical trainer.

2. Description of the Related Art

An elliptical trainer is a recently developed cardio-respiratory fitness exercise machine for shuffling the feet back and forth within their elliptically shaped paths to simulate walking, running, or stair climbing without causing excessive pressure to the joints. Simply speaking, an elliptical trainer generally comprises two pedals, a flywheel, two pedal links coupled between the pedals and the flywheel, sliding tracks, a roller pivotally mounted at the rear side of each pedal and movable along one respective sliding track, and two swing rods respectively connected to the pedals by a respective support rod.

Thus, when the user pedals the left and right pedals, the pedal links are moved to rotate the flywheel, and the rollers are moved with the pedal links back and forth along the respective sliding tracks. At the same time, the pedals are moved along their elliptically shaped paths and the user's hands are moved with the respective swing rods back and forth to simulate walking, running, or stair climbing.

Regular elliptical trainers commonly use a multi-link structure to couple movable component parts together. In order to correct the effects of cumulative tolerances due to the functioning of the multi-link structure in an elliptical trainer, rod end bearings are set between support tubes and swing rods. However, the installation locations of the rod end bearings cannot provide an accurate correction function. Under this condition, the cumulative tolerances among the component parts will also be guided to the rollers during the operation of the elliptical trainer, causing moving instability of the rollers and noises. When it is more serious, the rollers may come off the sliding tracks, affecting user safety.

SUMMARY OF THE INVENTION

The present invention has been accomplished under the circumstances in view. It is the main object of the present invention to provide a pedal correction mechanism for elliptical trainer, which effectively eliminate cumulative tolerances, avoiding derailment and reducing noises during the operation of the elliptical trainer/

To achieve this and other objects of the present invention, a pedal correction mechanism for elliptical trainer comprises a pedal link, a pedal bracket and a pedal. The pedal link comprises a coupling portion at an inner side thereof. The pedal bracket comprises a shaft pivotally inserted into the coupling portion of the pedal link for allowing the pedal bracket to be biased leftwards and rightwards on the axis of the shaft relative to the pedal link. The pedal is mounted at the top side of the pedal bracket for allowing a user to step thereon. By means of biasing of the pedal bracket leftwards and rightwards relative to the pedal link, cumulative tolerances among component parts can be eliminated, achieving the object of the present invention.

Further, the pedal bracket comprises a bracket frame, a connection tube, and a connection member. The bracket frame comprises a first connection hole located on each of two opposing sidewalls thereof. The connection tube is set between the two opposing sidewalls of the bracket frame and carrying the shaft on the periphery thereof in a radial direction. The connection member is inserted through the two first connection holes of the bracket frame and the connection tube, and then locked to the bracket frame. The pedal comprises two connection lugs and a second connection hole located on each connection lug for the passing of the connection member.

Preferably, the pedal correction mechanism further comprises a support tube and a U-shaped connection plate. The support tube has one end thereof connected to the pedal bracket and an opposite end thereof connected to two distal ends of the U-shaped connection plate to hold one swing rod of the elliptical trainer in between the support tube and the U-shaped connection plate.

Other advantages and features of the present invention will be fully understood by reference to the following specification in conjunction with the accompanying drawings, in which like reference signs denote like components of structure.

DETAILED DESCRIPTION OF THE INVENTION

Figure 1:
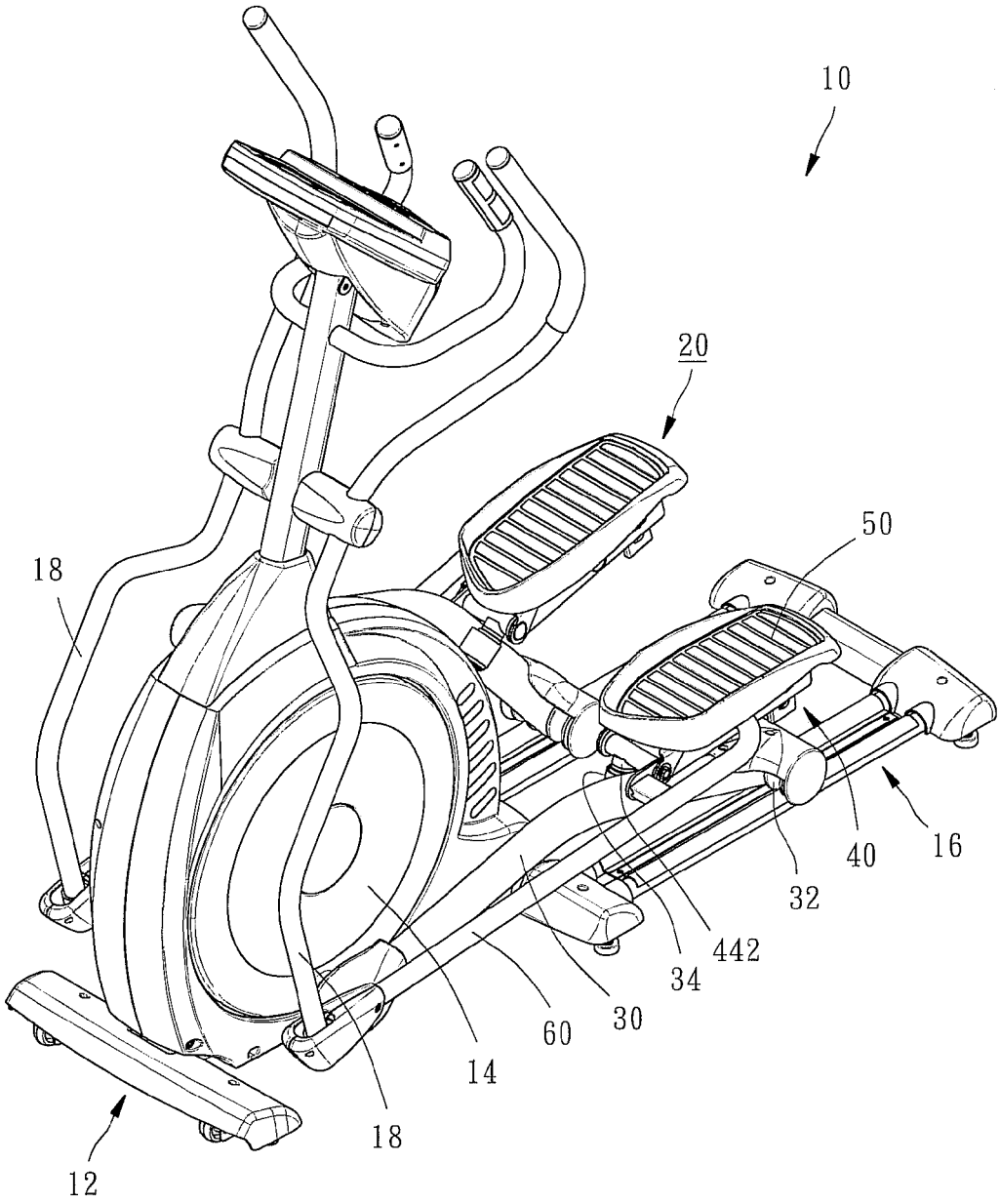
FIG. 1 is an elevational view of an elliptical trainer constructed in accordance with the present invention.

Referring to FIG. 1, an elliptical trainer 10 is shown comprising a base frame 12, a flywheel 14 rotatably mounted at the front side of the base frame 12, two sliding tracks 16 arranged in a parallel manner at the rear side of the base frame 12, and two swing rods 18 disposed at two opposite lateral sides relative to the flywheel 14.

Figure 2:
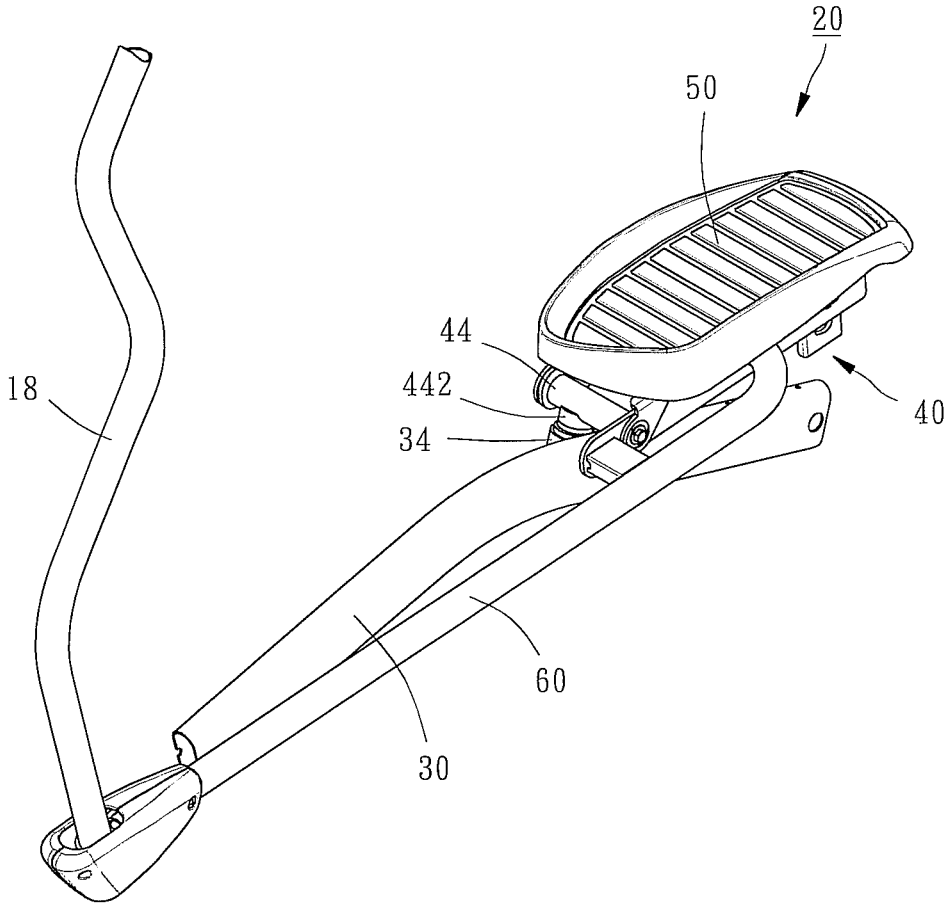
FIG. 2 is an elevational view of a part of the elliptical trainer shown in FIG. 1, illustrating the structural details of the pedal correction mechanism.
Figure 3:
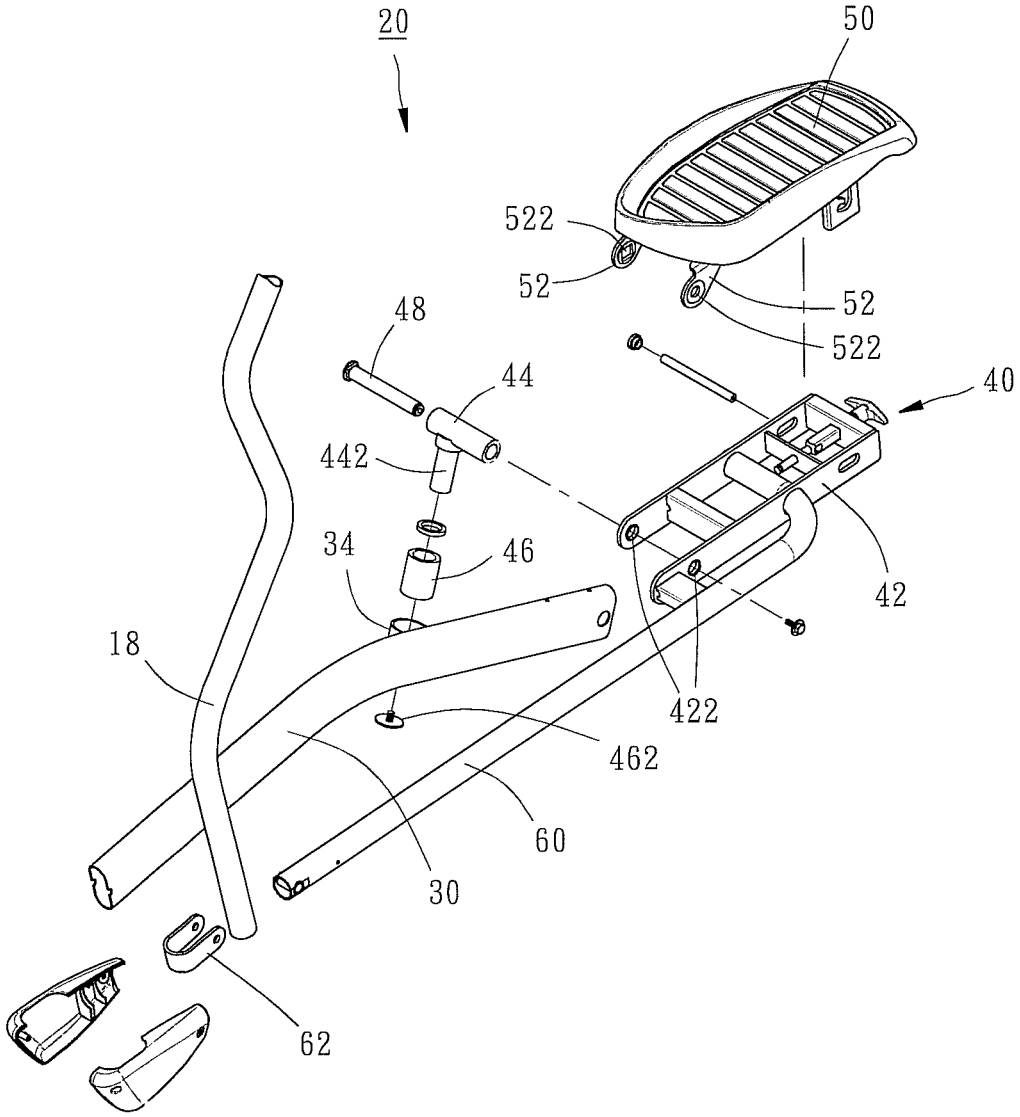
FIG. 3 is an exploded view of FIG. 2.

Referring to FIG. 2 and FIG. 1 again, the elliptical trainer 10 is equipped with a pedal correction mechanism 20. The pedal correction mechanism comprises two pedal link 30, two pedal brackets 40, two pedals 50, and two support tubes 60. As these two sets of component parts are identical, only one set of component parts will be explained hereinafter to save space.

The pedal link 30 has its front end coupled to the flywheel 14, and its rear end mounted with a roller 32 that is movable along one sliding track 16 of the elliptical trainer 10. Therefore, the pedal link 30 can be driven by the flywheel 14 to move the roller 32 back and forth along the sliding track 16. Further, the coupling portion 34 is a U-shaped locating plate deposed on the inner side of the pedal link 30.

The pedal bracket 40 comprises a bracket frame 42, a connection tube 44, a bushing 46 and a connection member 48. The bracket frame 42 has a first connection hole 422 located on each of two opposing sidewalls thereof. The connection tube 44 is set between the two opposing sidewalls of the bracket frame 42, having a shaft 442 radially extended from the periphery and pivotally inserted into the coupling portion 34 of the pedal link 30 for allowing the pedal bracket 40 to be biased leftwards and rightwards on the axis of the shaft 442 relative to the pedal link 30. The bushing 46 is sleeved onto the shaft 442 and stopped in place by a headed screw 462 that is fastened to the bottom end of the shaft 442. The connection member 48 is inserted through the first connection holes 422 of the bracket frame 42 and the connection tube 44, and then locked to the bracket frame 42.

The pedal 50 comprises two connection lugs 52 located on the front side thereof and a second connection hole 522 at each connection lug 52 for the passing of the connection member 48 of the pedal bracket 40 to secure the pedal 50 to the pedal bracket 40.

The support tube 60 has its one end connected to the pedal bracket 40 and its other end connected to two distal ends of a U-shaped connection plate 62 that secures one swing rod 18 of the elliptical trainer 10 to the support tube 60.

Figure 4:
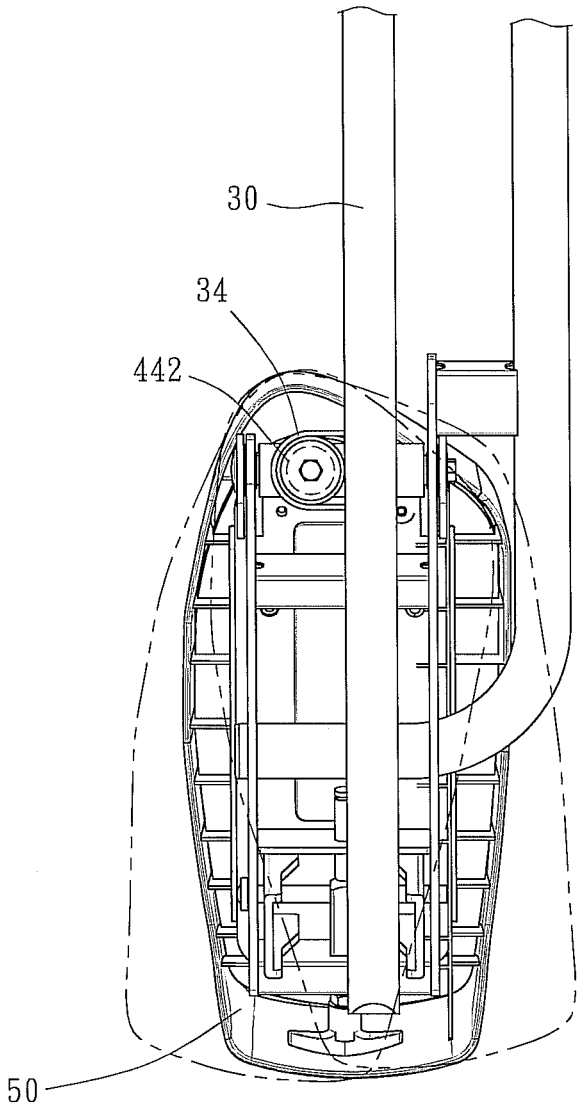
FIG. 4 is a schematic rear side view of the present invention, illustrating biasing of the pedal bracket.

Thus, when the pedal 50 is forced by a pressure from the user's foot to move along an elliptically shaped path, the biasing force produced during movement of the pedal link 30 with the flywheel 14 due to the effects of cumulative tolerance will be guided to the space between the shaft 442 of the pedal bracket 40 and the coupling portion 34 of the pedal link 30. As the swing rod 18 and the support tube 60 are connected together, the cumulative tolerance between the swing rod 18 and the support tube 60 will also be guided to the space between the shaft 442 of the pedal bracket 40 and the coupling portion 34 of the pedal link 30. Thus, the pedal bracket 40 and the pedal 50 will be biased leftwards and rightwards relative to the pedal link 30 subject to matching between the shaft 442 and the coupling portion 34, as shown in FIG. 4, to eliminate cumulative tolerances among component parts, preventing derailment and reducing noises and further achieving the object of the present invention.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A pedal correction mechanism used in an elliptical trainer, comprising:

a pedal link comprising a coupling portion at an inner side thereof;

a pedal bracket comprising a shaft pivotally inserted into said coupling portion of said pedal link for allowing said pedal bracket to slant leftwards and rightwards on the axis of said shaft relative to said pedal link wherein said pedal bracket comprises a bracket frame, a connection tube, and a connection member, said bracket frame comprising a first connection hole located on each of two opposing sidewalls thereof, said connection tube being set between the two opposing sidewalls of said bracket frame and carrying said shaft on the periphery thereof in a radial direction, said connection member being inserted through the two first connection holes of said bracket frame and said connection tube and locked to said bracket frame; said pedal comprises two connection lugs and a second connection hole located on each said connection lug for the passing of said connection member; and a pedal mounted at a top side of said pedal bracket.

2. The pedal correction mechanism as claimed in claim 1, wherein said pedal bracket further comprises a bush sleeved onto said shaft.

3. The pedal correction mechanism as claimed in claim 1, further comprising a support tube and a U-shaped connection plate, said support tube having one end thereof connected to said pedal bracket and an opposite end thereof connected to two distal ends of said U-shaped connection plate to hold one swing rod of the elliptical trainer in between said support tube and said U-shaped connection plate.

4. The pedal correction mechanism as claimed in claim 1, wherein said coupling portion is a U-shaped locating plated deposed on the inner side of said pedal link.

* * * * *